US010614936B2

(12) United States Patent
Hsu

(10) Patent No.: US 10,614,936 B2
(45) Date of Patent: Apr. 7, 2020

(54) VARISTOR MODULE

(71) Applicant: POWERTECH INDUSTRIAL CO., LTD., New Taipei (TW)

(72) Inventor: Jung-Hui Hsu, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/416,383

(22) Filed: May 20, 2019

(65) Prior Publication Data

US 2020/0035387 A1 Jan. 30, 2020

(30) Foreign Application Priority Data

Jul. 25, 2018 (TW) ..... 107125715 A

(51) Int. Cl.
*H01C 7/12* (2006.01)
*H01C 7/102* (2006.01)
*H01C 7/02* (2006.01)

(52) U.S. Cl.
CPC ..... *H01C 7/12* (2013.01); *H01C 7/02* (2013.01); *H01C 7/102* (2013.01)

(58) Field of Classification Search
CPC ..... H01C 7/12; H01C 7/102; H01C 7/126; H01C 7/13; H01H 85/44
See application file for complete search history.

(56) References Cited

U.S. PATENT DOCUMENTS

| | | | | |
|---|---|---|---|---|
| 6,430,019 | B1 * | 8/2002 | Martenson | H01C 7/126 361/103 |
| 8,378,778 | B2 * | 2/2013 | Duval | H01C 7/126 338/20 |
| 8,502,637 | B2 * | 8/2013 | Guarniere | H01C 7/10 338/21 |
| 2012/0105191 | A1 * | 5/2012 | Wang | H01C 7/126 337/414 |
| 2015/0171622 | A1 * | 6/2015 | Lee | H01C 7/126 361/93.7 |

* cited by examiner

*Primary Examiner* — Kyung S Lee
(74) *Attorney, Agent, or Firm* — Li & Cai Intellectual Property (USA) Office

(57) ABSTRACT

A varistor module includes a base, a case, a varistor body and a metal flat spring. The base has two limit structures. The case is assembled with the base and to form a closed space. The limit structures are disposed in the closed space. The varistor body includes a ceramic chip and two limit pins. The ceramic chip has two electrode layers located on two opposite surfaces, respectively. The limit pins are disposed on the electrode layers, respectively. The limit pins extend outward from the corresponding electrode layers and pass through the limit structures. One of the limit pins forms a splice segment between the electrode layer and the limit structure. The metal flat spring is disposed on the base. One end of the metal flat spring passes out of the closed space, and the other end of the metal flat spring is connected to the splice segment.

14 Claims, 7 Drawing Sheets

VARISTOR MODULE

CROSS-REFERENCE TO RELATED PATENT APPLICATION

This application claims the benefit of priority to Taiwan Patent Application No. 107125715, filed on Jul. 25, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a varistor module, and more particularly to a varistor module combined with a temperature protection element.

BACKGROUND OF THE DISCLOSURE

Surge protection elements can be used to protect electrical equipment from damage caused by transient surges in everyday life. In order to prevent the surge protection elements from overheating due to aging or abnormal power supply and even igniting, a surge protection element is usually designed with a temperature protection element. The temperature protection element can disconnect circuit before the surge protection element reaches the ignition temperature to avoid further hazard.

In conventional technique, a surge protection element has been combined with a temperature protection element, so that the temperature protection element can protect the surge protection element more closely and respond more quickly, and can reduce the number of elements and reduce space used on a printed circuit board (PCB). However, due to poor fastening of the surge protection element, a commercially available surge absorber with a temperature protection element (varistor) is easily damaged and cannot reliably provide protective function. Therefore, conventional surge absorbers need to be improved in assembly and positioning.

In summary, the present inventors had felt that the above-mentioned defects can be improved, and the present disclosure has been put forward with great interest in designing and cooperating with the theory, and finally proposes a design which is reasonable in design and effective in improving the above defects.

SUMMARY OF THE DISCLOSURE

In response to the above-referenced technical inadequacies, the present disclosure provides a varistor module that can stably limit a varistor body to prevent the varistor body from damage.

In one aspect, the present disclosure provides a varistor module including a base, a case, a varistor body, and a metal flat spring. The base has two limit structures. The case is assembled with the base and forms a closed space. The limit structures are disposed in the closed space. The varistor body includes at least one ceramic chip, and two limit pins.

The at least one ceramic chip is disposed in the closed space. The ceramic chip has two electrode layers located on two opposite surfaces, respectively. The limit pins are disposed on the electrode layers, respectively. The limit pins extends outward from the corresponding electrode layers and pass through the limit structures to limit the varistor body in the closed space. The limit pins pass through the base, and at least one of the limit pins forms a splice segment between the electrode layer and the limit structure. The metal flat spring is disposed on the base. One end of the metal flat spring passes out of the closed space, and the other end of the metal flat spring is connected to the splice segment.

In certain embodiments, each limit structure includes a column body, and the corresponding limit pin extends into the interior of the column body from the top surface of the column body so as to limit the position of the varistor body.

In certain embodiments, the height of the limit structure on the base is higher than ½ height of the ceramic chip on the base.

In certain embodiments, the length of the metal flat spring in the closed space is defined as a first length, and the first length is higher than or equal to the height of the ceramic chip on the base.

In certain embodiments, each limit pin extends outward from the corresponding electrode layer in a planar direction of the ceramic chip.

In certain embodiments, the length of the splice segment is longer than the width of the metal flat spring.

In certain embodiments, part of the metal flat spring is embedded in the base.

In certain embodiments, the number of the ceramic chip is two or more, and the varistor body further includes at least one auxiliary pin corresponding to the number of the ceramic chip. The auxiliary pin is disposed on one of the electrode layers and extends outward from the electrode layer, and the auxiliary pin passes through the limit structure and extends outside the base.

In certain embodiments, each limit structure further includes a stop portion protruding from the column body, and the stop portion assists the limit of the varistor body.

In certain embodiments, the stop portion is disposed on the side surface of the column body. The stop portions are against two sides of the ceramic chip when the varistor body moves.

In certain embodiments, the stop portion is disposed on the top surface of the column body. The stop portions are against the limit pins when the varistor body moves.

In certain embodiments, the base further includes two auxiliary limit structures which are disposed on two sides of the ceramic chip, respectively. The auxiliary limit structures protrude toward the closed space.

In certain embodiments, at least one of the base and the case is made of a material containing ceramic.

In certain embodiments, at least one of the base and the case is made of a material containing glass fiber.

Therefore, the limit pins of the varistor body of the present disclosure are disposed on the electrode layers, respectively. The limit pins extend outward from the corresponding electrode layers and pass through the limit structures to limit the varistor body in the closed space, so that the limit pins can stably limit the position of the varistor body and prevent the varistor body from damage.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
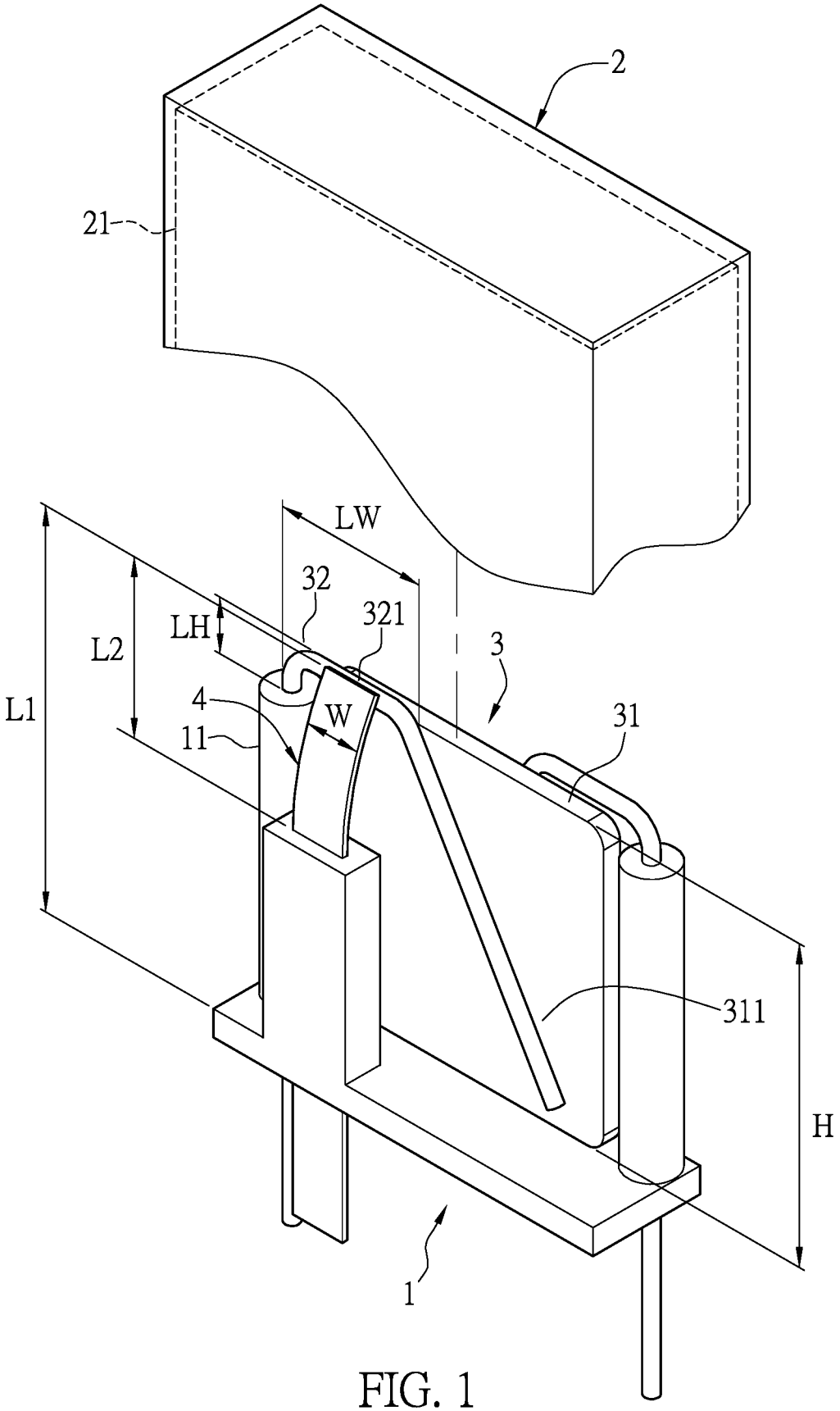
FIG. 1 is a perspective view showing a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
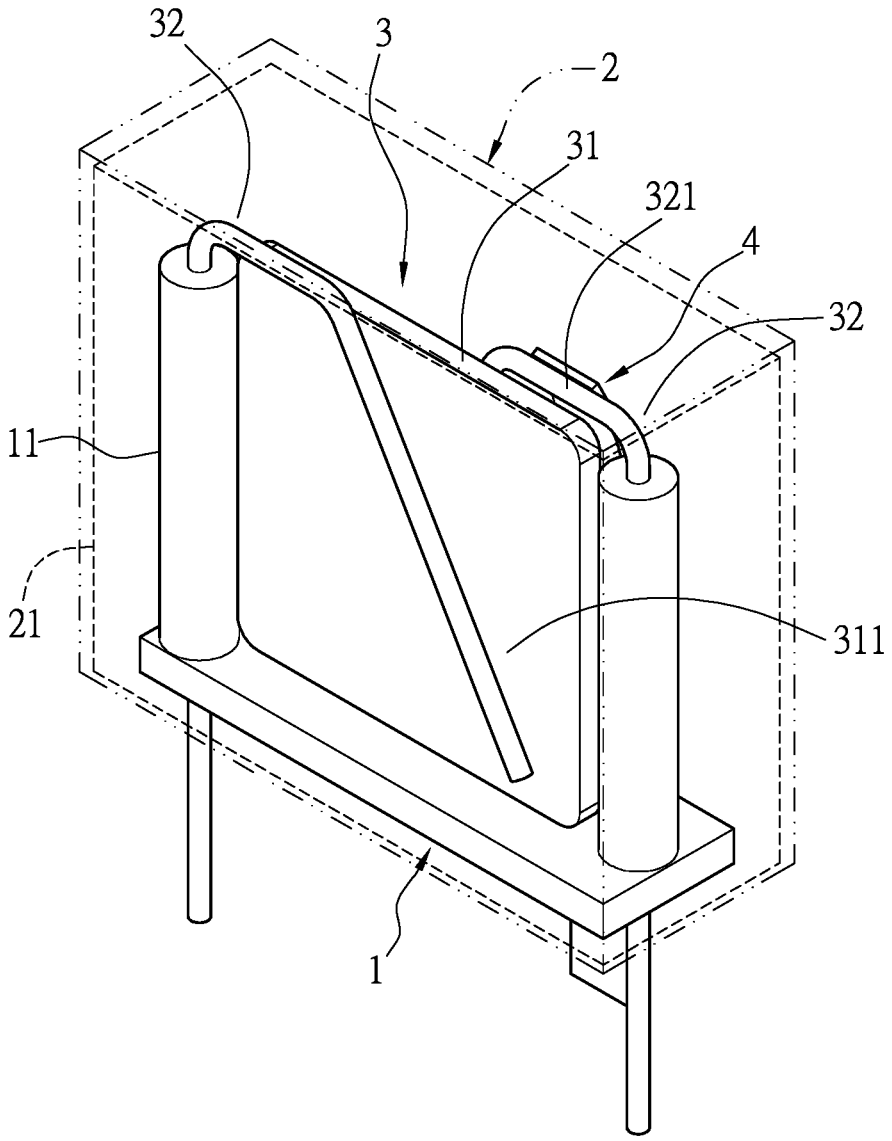
FIG. 2 is a perspective view in another angle showing the first embodiment of the present disclosure.

Referring to FIG. 1 and FIG. 2, a first embodiment of the present disclosure provides a varistor module, also known as a surge absorber, including a base 1, a case 2, a varistor body 3, and a metal flat spring 4.

Preferably, the base 1 is made of a material containing ceramic or glass fiber, but is not limited thereto. The base 1 has two limit structures 11 which can be used to limit the position of the varistor body 3. In this embodiment, each limit structure 11 has a column body, such as a cylindrical column, disposed on the base 1, and the column body extends to adequate height. The structure of the limit structures 11 is not limited there to.

Preferably, the case 2 is made of a material containing ceramic or glass fiber, but is not limited thereto. At least one of the base 1 and the case 2 contains ceramic or fiber glass. The case 2 is a hollow body, and one end (lower end) of the case 1 is open. The case 2 and the base 1 are assembled together and form a closed space 21. The limit structures 11 are disposed in the closed space 21.

The varistor body 3 includes at least one ceramic chip 31 and two limit pins 32. The ceramic chip 31 is disposed in the closed space 21. The ceramic chip 31 has two electrode layers 311 located on two opposite surfaces, respectively. The limit pins 32 are disposed on the electrode layers, respectively. The limit pins 32 extend outward from the corresponding electrode layers 311 and pass through the limit structures 11 to limit the varistor body 3 in the closed space 21. In this embodiment, each limit pin 32 extends outward from the corresponding electrode layer 311 in a planar direction of the ceramic chip 31.

In this embodiment, the column body of the limit structure 11 is hollow, and each limit pin 32 passes through the column body from the top surface of the column body so as to limit the position of the varistor body 3. Preferably, the height of the limit structure 11 on the base 1 is higher than ½ height of the ceramic chip 31 on the base 1, which has better position limiting ability. The limit pins 32 pass through and out of the base 1, and at least one of the limit pins 32 forms a splice segment 321 between the electrode layer 311 and the limit structure 11.

The metal flat spring 4 is a strip-shaped elastic sheet. The metal flat spring 4 is disposed on the base 1 such that the metal flat spring 4 is disposed in the closed space 21. Preferably, the metal flat spring 4 can be embedded in the base 1, so that the metal flat spring 4 can be more firmly disposed on the base 1. One end (lower end) of the metal flat spring 4 passes out of the closed space 21, and the other end (upper end) of the metal flat spring 4 is connected to the splice segment 321. In this embodiment, the metal flat spring 4 can be disposed on the base 1 to provide stable deformation support of the metal flat spring 4, and then applying an external force to push the metal flat spring 4 touching the splice segment 321 of the limit pin 32 of the varistor body 3, and connecting the metal flat spring 4 and the limit pin 32 through low melting point solder. At this time, the adhesion force of the solder is higher than the restitution force of the metal flat spring 4, so that the other end of the metal flat spring 4 can be firmly connected to the splice segment 321. Preferably, the melting point of the solder is between 100° C. to 200° C., but is not limited thereto.

The splice segment 321 can arbitrarily extend between the limit structure 11 and the electrode layer 311 in different configurations, and has a splice segment height LH and a splice segment width LW. In this embodiment, the splice segment width LW is longer than the width W of the metal flat spring 4. Preferably, the length of the metal flat spring 4 in the closed space 21 is defined as a first length L1, and the first length L1 is higher than or equal to the height H of the ceramic chip 31 on the base 1. Corresponding to the height of the limit structure 11, the height of the ceramic chip 31, or the height of the metal flat spring 4, the splice segment 321 can extend in different configurations to change its width and height, that is the splice segment height LH and the splice segment width LW. The splice segment 321 can be exemplify as: extending upward from the limit structure 11 for a longer length and then bending so as to have longer splice segment height LH, and then extending toward the opposite limit structure 11 for a longer length and then bending so as to have longer segment width LW, and then extending toward the ceramic chip 31 to connect the electrode layer 311. The metal flat spring 4 can be connected to any part of the splice segment 321, such as the horizontal portion or the vertical portion of the splice segment 321 relative to the base 1. In this embodiment, shown in FIG. 1, the metal flat spring 4 is connected to the horizontal portion of the splice segment 321, but is not limited thereto. The metal flat spring 4 can also be connected to the vertical portion adjacent to the limit structure 11 or connected to the inclined portion adjacent to the electrode layer 311. Furthermore, for instance, when the splice segment height LH is higher, the vertical portion of the splice segment 321 provides more areas for the metal flat spring 4 to connect. Adjustment of the splice segment height LH and the splice segment width LW is beneficial for the limit pin 32 to collocate with the metal flat spring 4 and the low melting point solder to control the whole connecting strength, so that the metal flat spring 4 can disconnect with the limit pin 32 at a predetermined temperature and the limit pins 32 maintain stable position limitation to the varistor body 3. According to a predetermined length of the metal flat spring 4 passing through the base 1 inside the closed space 21, the height of the base 1 corresponding to the position to the metal flat spring 4 can be adjusted. That is, the length of the metal flat spring 4 passing through the base 1 is defined as a second length L2, and the second length L2 can be adjusted according to the design considerations. Cooperated with the first length L1, which is higher than or equal to the height H of the ceramic chip 31 on the base 1, the second length L2 can be adjusted in a wider range according to the consideration to the whole adhesion force of the metal flat spring 4, the solder, and the limit pins 3, so that the metal flat spring 4 can be effectively and reliably disconnected from the limit pin 32 when the solder reaches predetermined melting point.

When the varistor module is abnormal and reaches a high temperature, the low melting point solder starts to change from solid state to liquid state, and at this time the adhesion force between the limit pin 32 and the metal flat spring 4 decreases. When the adhesion force is lower than the elastic deformation force of the metal flat spring 4, the metal flat spring 4 reverts to the state before the deformation caused by the external force and is disconnected from the limit pins 32, so that the varistor module is in an open circuit state and is prevented from further generating excess heat to achieve a protective effect.

The limit pins 32 of the varistor body 3 of the present disclosure are disposed on the electrode layers 311, respectively. The limit pins 32 extend outward from the corresponding electrode layers 311 and pass through the limit structures 11 to limit the varistor body 3 in the closed space 21, so that the limit pins 32 can stably limit the position of the varistor body 3 and prevent the varistor body 3 from damage to assuredly play protective function. In addition, the limit structures 11 make the varistor body 3 easier to be positioned and assembled, so that the solder can be accurately adhered to the limit pins 32 and the metal flat spring 4, and the temperature for disconnecting the metal flat spring 4 and the limit pin 32 is more steady and accurate.

The closed space 21 formed by the base 1 and the case 2 of the present disclosure effectively isolates the varistor body 3 from the external environment to reduce the possibility of burning, and the base 1 and the case 2 are made of a material containing heat resistant material, such as the material containing ceramic or glass fiber, to achieve better heat resistance.

Second Embodiment

Figure 3:
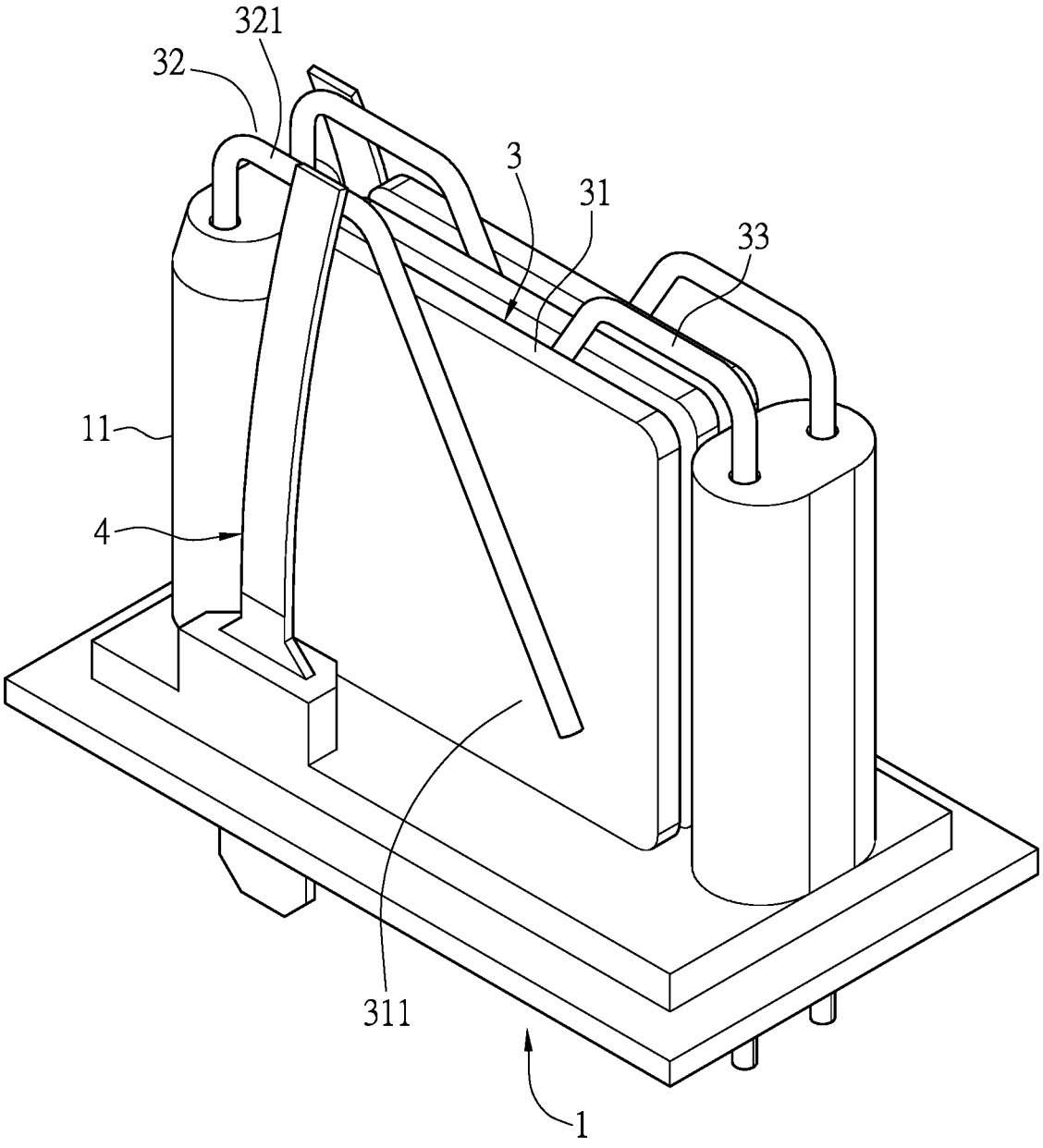
FIG. 3 is a perspective view showing a second embodiment of the present disclosure.
Figure 4:
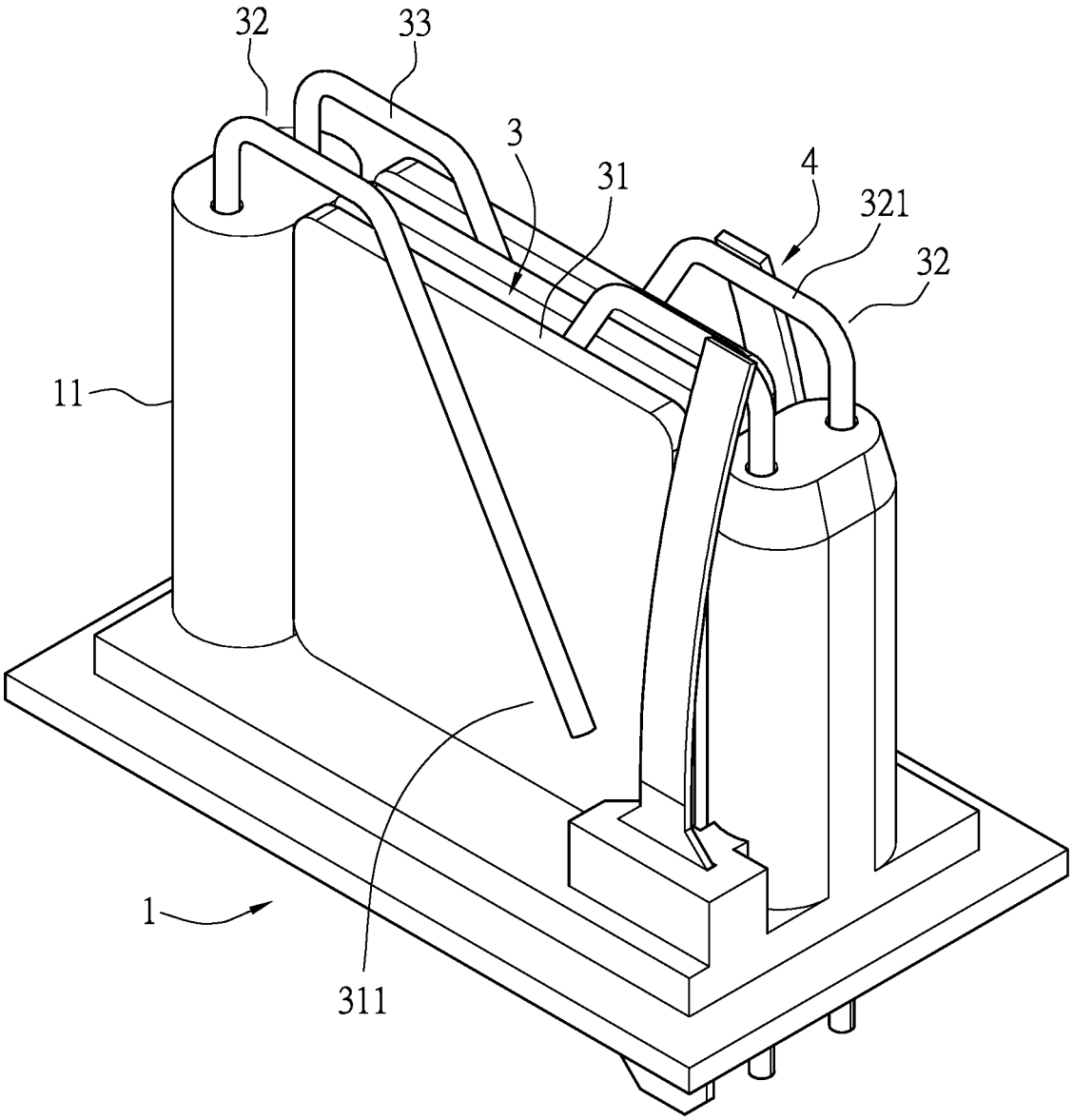
FIG. 4 is a perspective view in another angle showing the second embodiment of the present disclosure.

Referring to FIG. 3 and FIG. 4, in this embodiment, the number of the ceramic chip 31 is two or more, and the varistor body 3 further includes at least one auxiliary pin 33 corresponding to the number of the ceramic chip 31. The auxiliary pin 33 is disposed on one of the electrode layers 311 and extends outward from the corresponding electrode layer 311. The auxiliary pin 33 passes through the limit structure 11 and directly extends outside the base 1. The auxiliary pin 33 can also directly pass through the base 1 without passing through the limit structure 11; preferably, the limit pins 32 and the auxiliary pin 33 extend outside the base 1 through the limit structure 11, which can improve the stability of the varistor body 3 within the varistor module. A three-hole household AC power plug and socket contain a live line L, a neutral line N, and a ground line G. When the number of the ceramic chip 31 is two or more, ends of the limit pins 32 and auxiliary pin 33 can be arbitrarily disposed on electrode layers 311 by design. The other ends of the limit pins 32 and the auxiliary pin 33 can be electrically connected to one of the live line L, the neutral line N, and the ground line G, or can be electrically connected to the metal flat spring 4 (protective device) in order to achieve, for example, overvoltage protection of different lines L/N/G in a three-hole socket.

Third Embodiment

Figure 5:
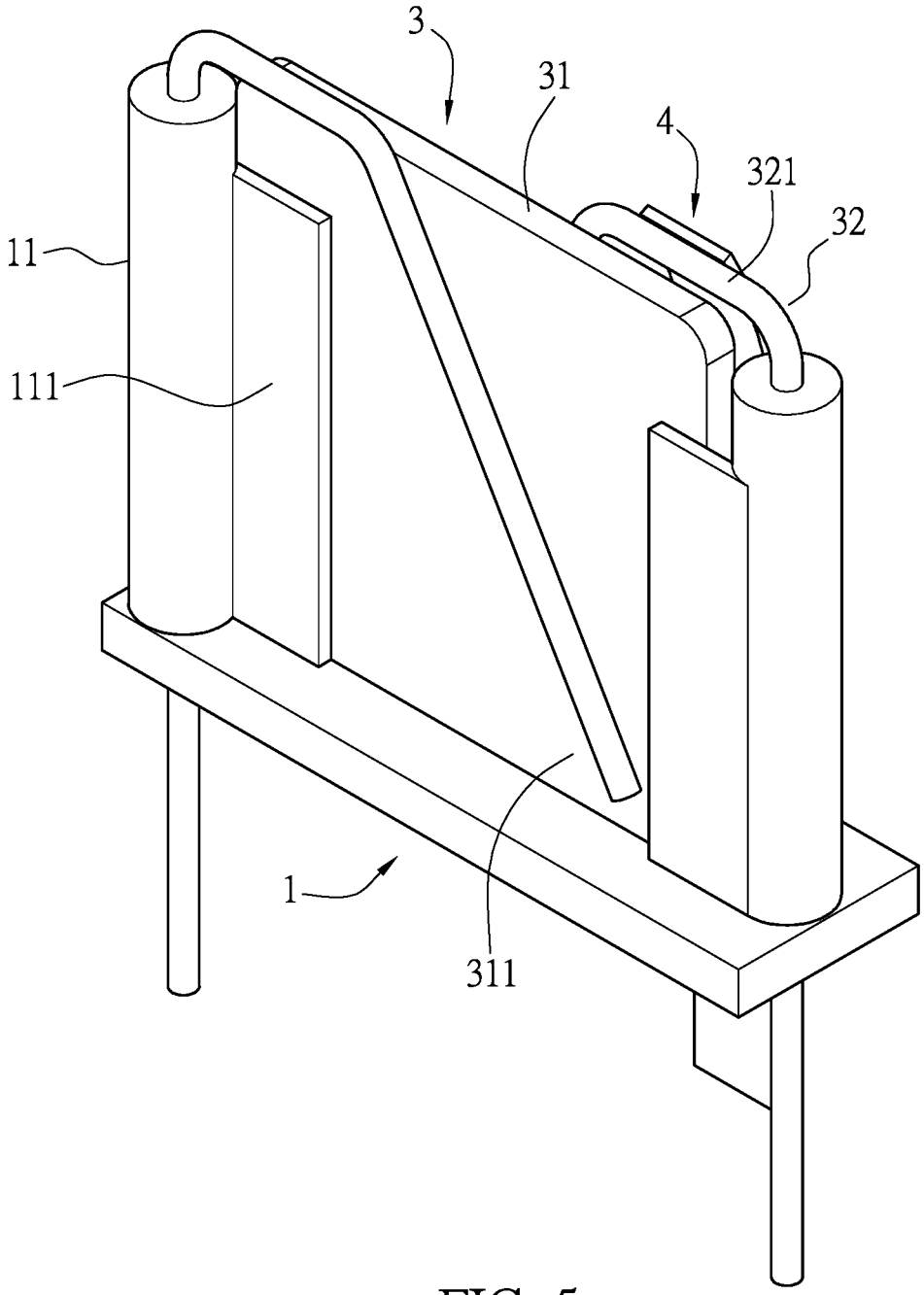
FIG. 5 is a perspective view showing a third embodiment of the present disclosure.

Referring to FIG. 5, in this embodiment, each limit structure 11 further includes a stop portion 111, and the stop portion 111 protrudes from the column body. The stop portion 111 assists the limit to the varistor body 3. The stop portion 111 is disposed on the side surface of the column body, and the stop portions 111 are abutted against two sides of the ceramic chip 31 for auxiliary limiting the position of the varistor body 3 when the varistor body 3 moves.

Fourth Embodiment

Figure 6:
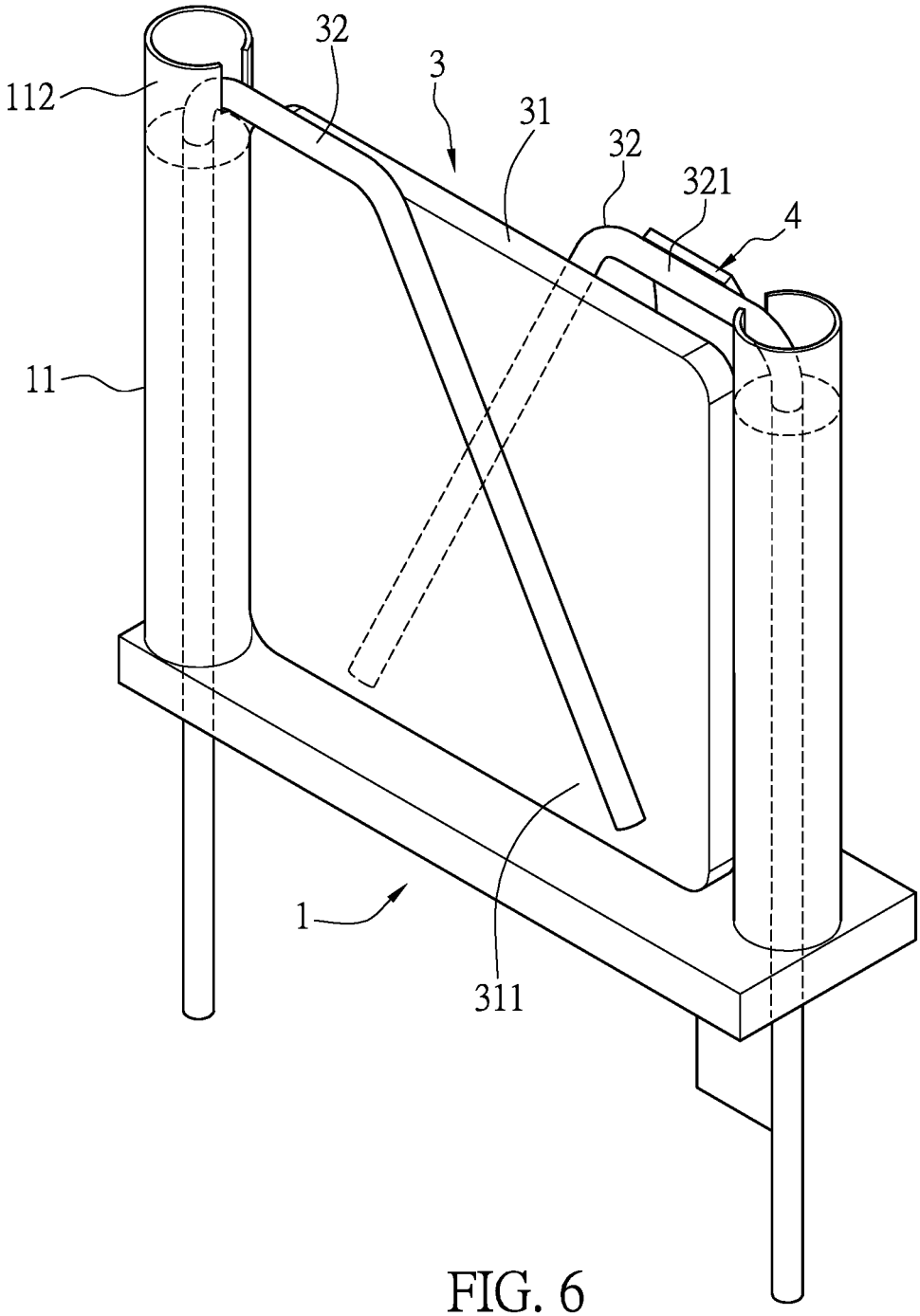
FIG. 6 is a perspective view showing a fourth embodiment of the present disclosure.

Referring to FIG. 6, in this embodiment, each limit structure 11 further includes a stop portion 112, and the stop portion 112 protrudes from the column body. The stop portion 111 assists the limit to the varistor body 3. The stop portion 112 is disposed on the top surface of the column body, and the stop portions 112 are abutted against the limit pins 32 for auxiliary limiting the position of the varistor body 3 when the varistor body 3 moves.

Fifth Embodiment

Figure 7:
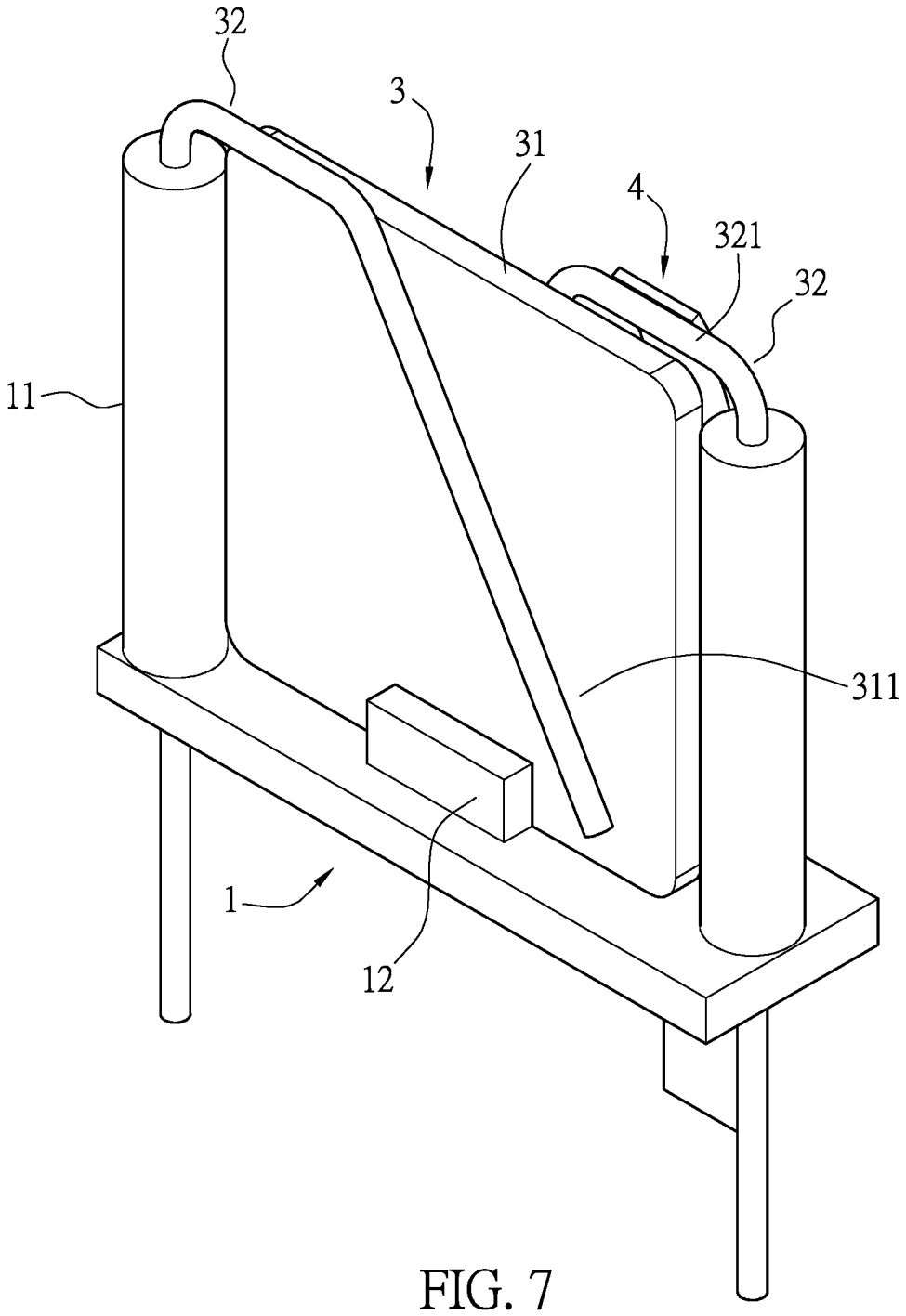
FIG. 7 is a perspective view showing a fifth embodiment of the present disclosure.

Referring to FIG. 7, in this embodiment, the base 1 further includes two auxiliary limit structures 12 for auxiliary limiting the position of the varistor body 3. The auxiliary limit structures 12 protrude toward the closed space 21 and are disposed on two sides of the ceramic chip 31, respectively. The auxiliary limit structures 12 are abutted against two sides of the ceramic chip 31 for auxiliary limitation the position of the varistor body 3 when the varistor body 3 moves.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A varistor module, comprising:

a base having two limit structures;

a case assembled with the base and to form a closed space, the limit structures disposed in the closed space; and a varistor body, including at least one ceramic chip disposed in the closed space, the ceramic chip having two electrode layers located on two opposite surfaces, respectively;

two limit pins disposed on the electrode layers, respectively, the limit pins extending outward from the corresponding electrode layers and passing through the limit structures to limit the varistor body in a predetermined position in the closed space, the limit pins passing through the base and at least one of the limit pins forming a splice segment between the electrode layer and the limit structure; and a metal flat spring disposed on the base, one end of the metal flat spring passing out of the closed space, and the other end of the metal flat spring connected to the splice segment.

2. The varistor module according to claim 1, wherein each limit structure includes a column body, and the corresponding limit pin extends into the interior of the column body from the top surface of the column body so as to limit the varistor body in the predetermined position.

3. The varistor module according to claim 1, wherein the height of the limit structure on the base is higher than ½ height of the ceramic chip on the base.

4. The varistor module according to claim 1, wherein the length of the metal flat spring in the closed space is defined as a first length, and the first length is higher than or equal to the height of the ceramic chip on the base.

5. The varistor module according to claim 1, wherein each limit pin extends outward from the corresponding electrode layer in a planar direction of the ceramic chip.

6. The varistor module according to claim 1, wherein the length of the splice segment is longer than the width of the metal flat spring.

7. The varistor module according to claim 1, wherein part of the metal flat spring is embedded in the base.

8. The varistor module according to claim 1, wherein the number of the ceramic chip is two or more, and the varistor body further includes at least one auxiliary pin corresponding to the number of the ceramic chip; the auxiliary pin is disposed on one of the electrode layers and extends outward from the electrode layer, and the auxiliary pin passes through the limit structure and extends outside the base.

9. The varistor module according to claim 2, wherein each limit structure further includes a stop portion protruding from the column body, and the stop portion assists with the limiting in the predetermined position of the varistor body.

10. The varistor module according to claim 9, wherein the stop portion is disposed on the side surface of the column body, the stop portions are against two sides of the ceramic chip when the varistor body moves.

11. The varistor module according to claim 9, wherein the stop portion is disposed on the top surface of the column body, the stop portions are against the limit pins when the varistor body moves.

12. The varistor module according to claim 1, wherein the base further includes two auxiliary limit structures which are disposed on two sides of the ceramic chip, respectively, and the auxiliary limit structures protrude toward the closed space.

13. The varistor module according to claim 1, wherein at least one of the base and the case is made of a material containing ceramic.

14. The varistor module according to claim 1, wherein at least one of the base and the case is made of a material containing glass fiber.

* * * * *